US005349786A

United States Patent [19]

Dorrah

[11] Patent Number: 5,349,786

[45] Date of Patent: Sep. 27, 1994

[54] APPARATUS AND METHOD FOR PRODUCING AND OSCILLATING, AN ORBITING AND A VIBRATING MOVEMENT ON A DISC BODY

[76] Inventor: James M. Dorrah, 8423 Champions, Wichita, Kans. 67226

[21] Appl. No.: 126,774

[22] Filed: Sep. 27, 1993

[51] Int. Cl.[5] ..... B24B 23/00

[52] U.S. Cl. ..... 451/357

[58] Field of Search ..... 51/170 R, 170 MT, 170 T, 51/168; 464/87, 89

[56] References Cited

U.S. PATENT DOCUMENTS

| | | | |
|---|---|---|---|
| 1,871,963 | 8/1932 | Dill | 51/168 |
| 2,295,282 | 9/1942 | Mall | 51/168 |
| 2,542,154 | 2/1951 | Mesirow | 51/168 |
| 2,629,990 | 3/1953 | Tocci-Guilbert | 51/168 |
| 2,633,008 | 3/1953 | Tocci-Guilbert | 51/168 |
| 2,666,307 | 1/1954 | Higert | 51/168 |
| 2,767,527 | 10/1956 | Tocci-Guilbert | 51/168 |
| 2,767,528 | 10/1956 | Tocci-Guilbert | 51/168 |
| 2,860,496 | 11/1958 | Tocci-Guilbert | 51/168 |
| 4,674,234 | 6/1987 | Reiling et al. | 51/168 |

*Primary Examiner*—Roscoe V. Parker
*Attorney, Agent, or Firm*—John Wade Carpenter

[57] ABSTRACT

A resilient coupling having a cup-shaped sleeve and an elastomeric pad disposed within the cup-shaped sleeve. A threaded hub is embedded with in the elastomeric pad. The bottom of the hub generally registers with an end of the elastomeric pad which is directly exposed to the atmosphere and is not covered.

20 Claims, 6 Drawing Sheets

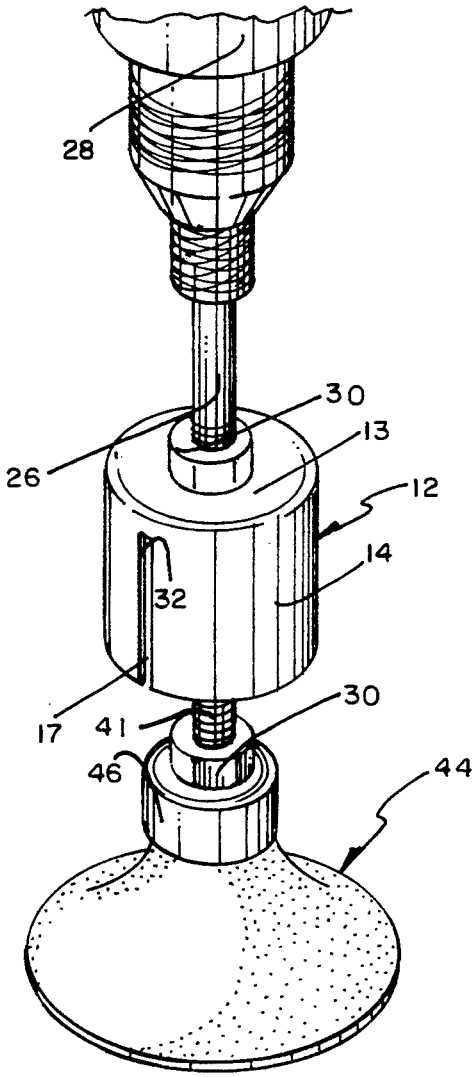
FIG. 1
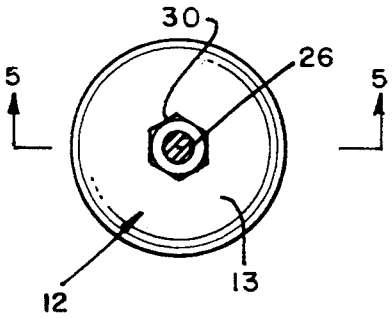
FIG. 2
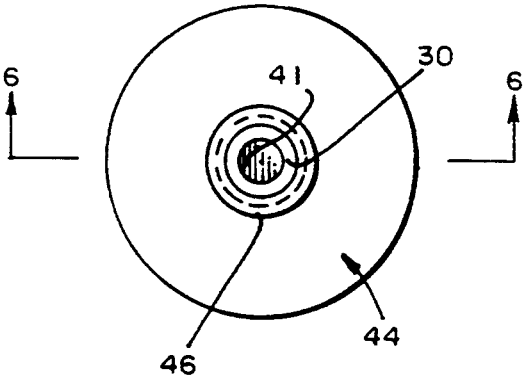
FIG. 3
FIG. 4
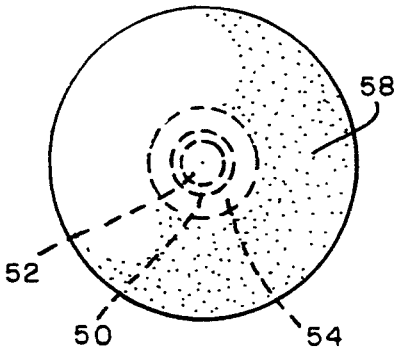

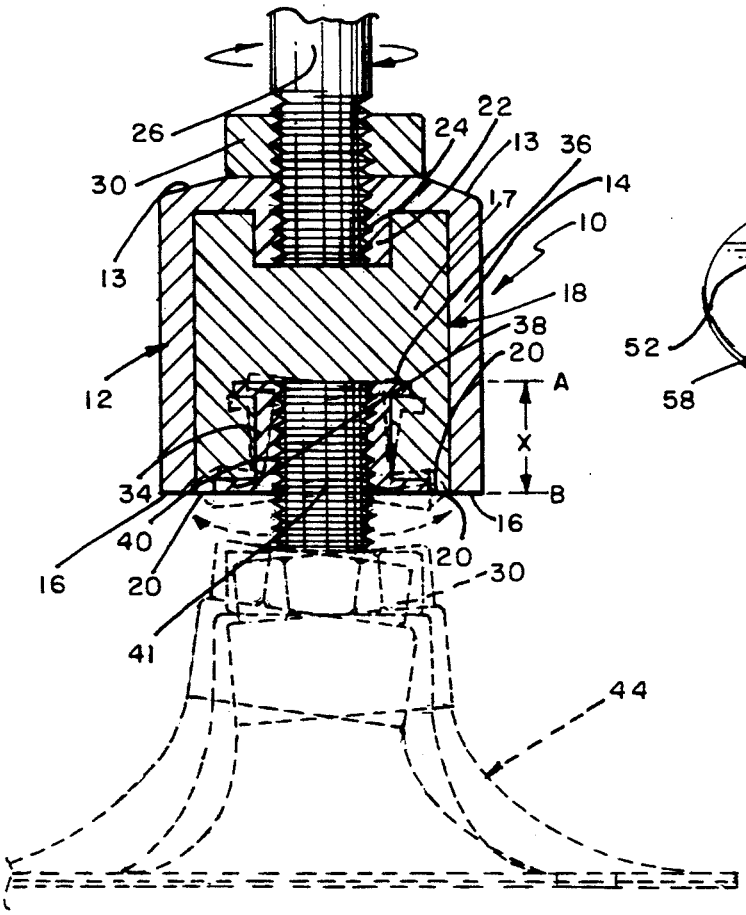
FIG. 5
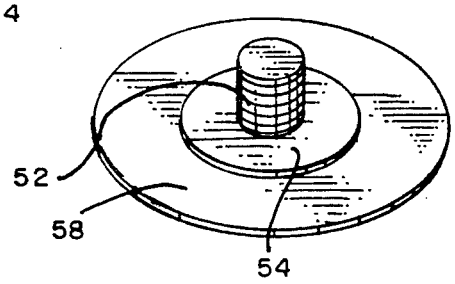
FIG. 7
FIG. 6
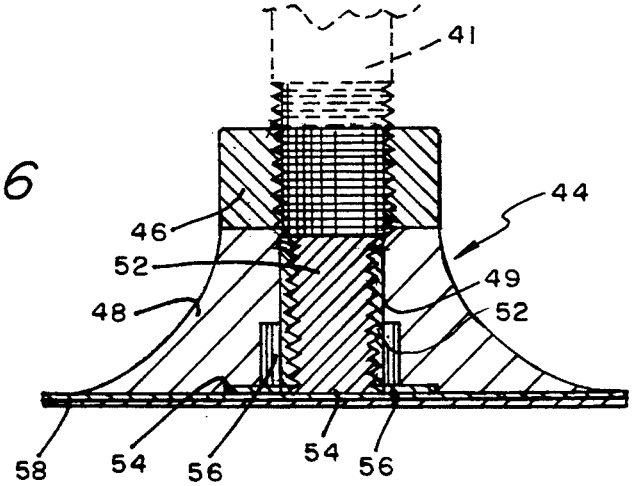
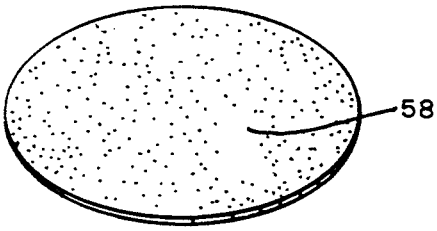
FIG. 8

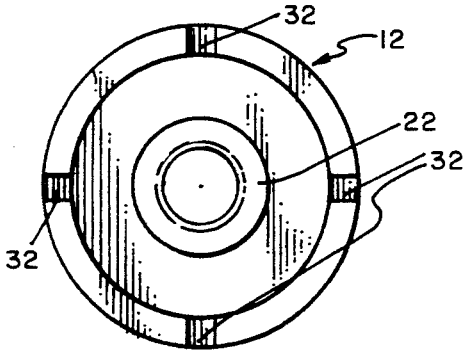
FIG. 13
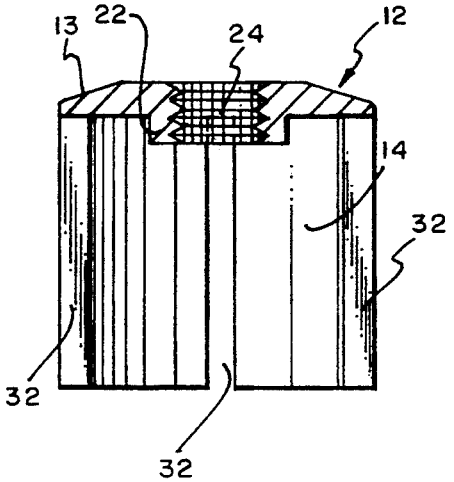
FIG. 14
FIG. 16
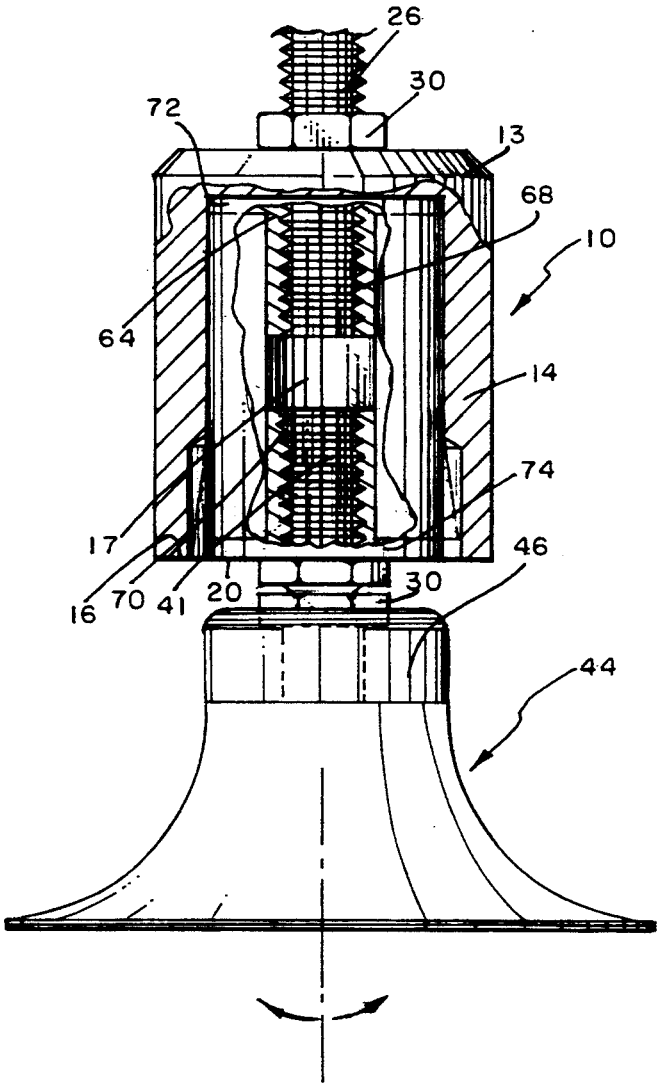
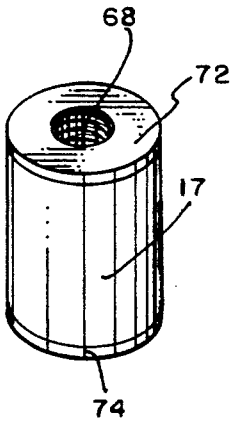
FIG. 15

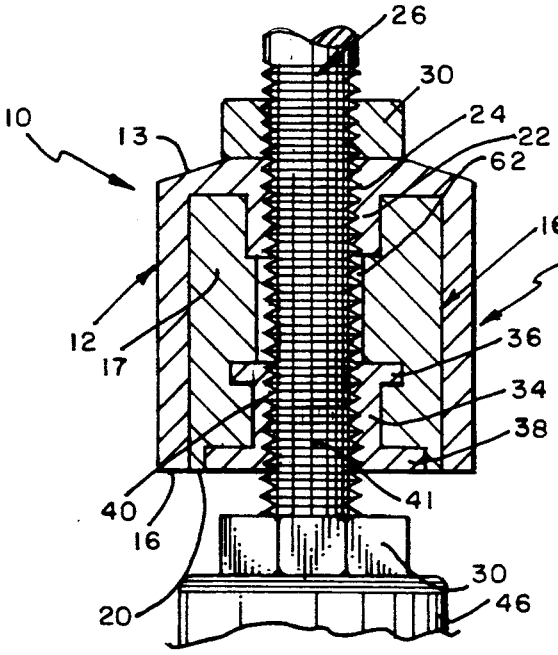
FIG. 17
FIG. 18
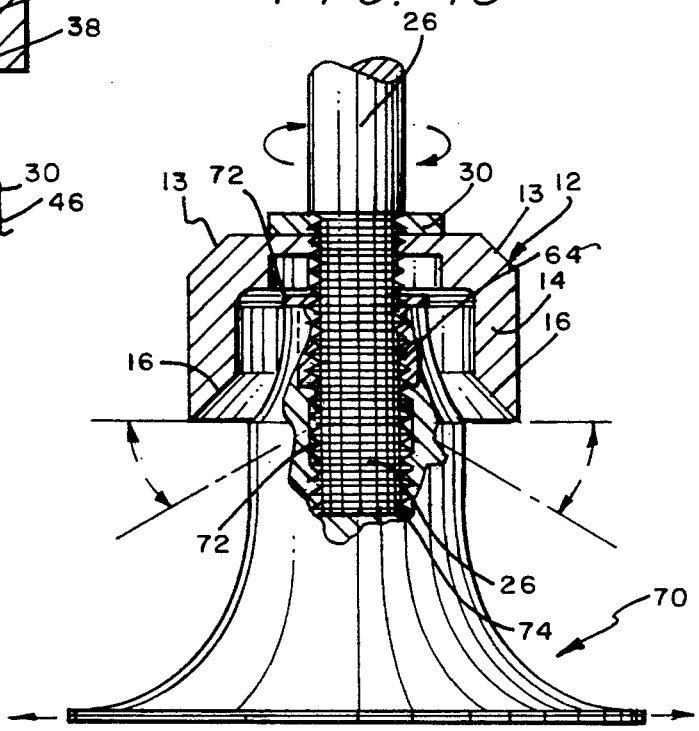
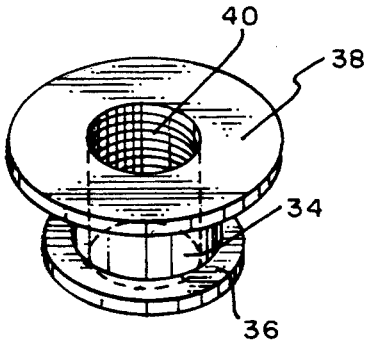
FIG. 20
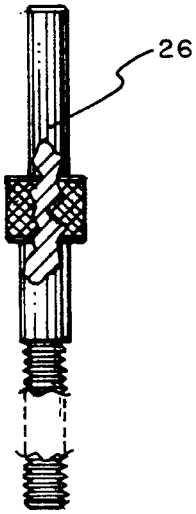
FIG. 21
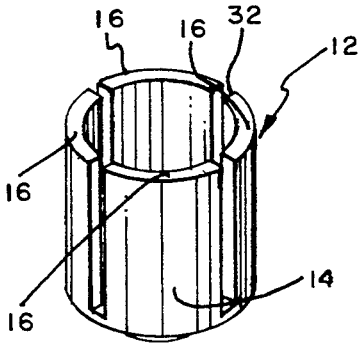
FIG. 19

FIG. 22
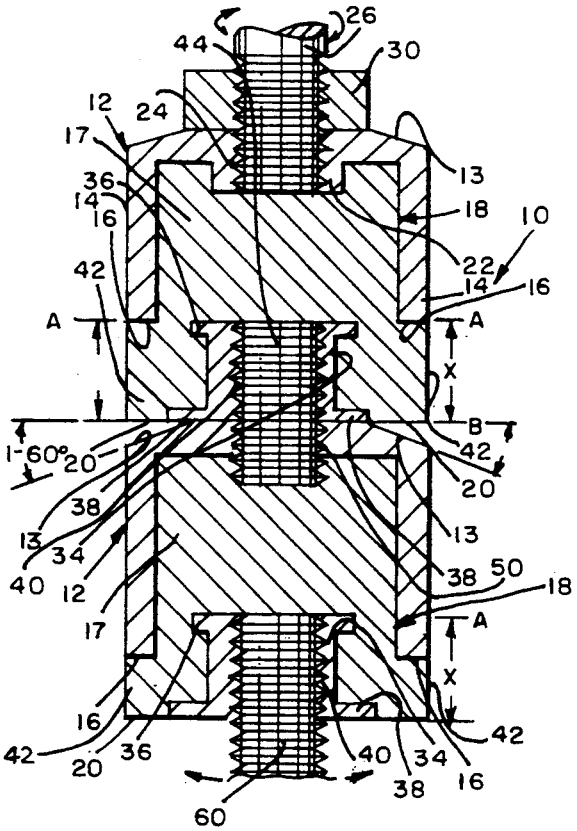
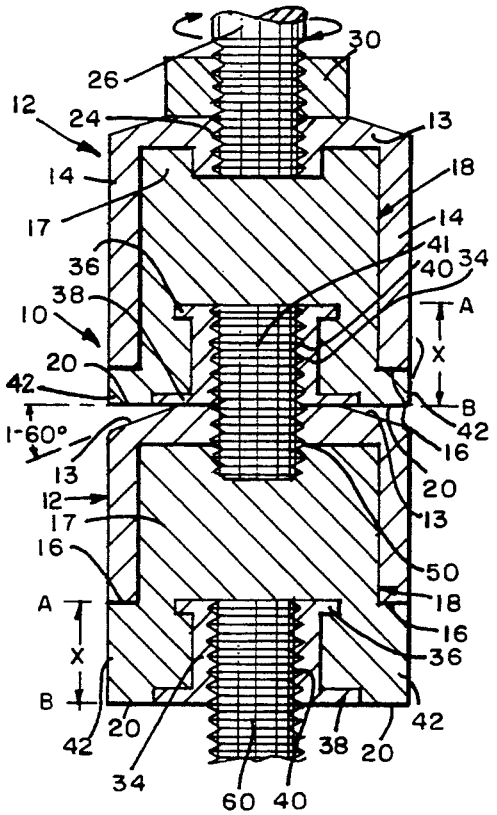
FIG. 23
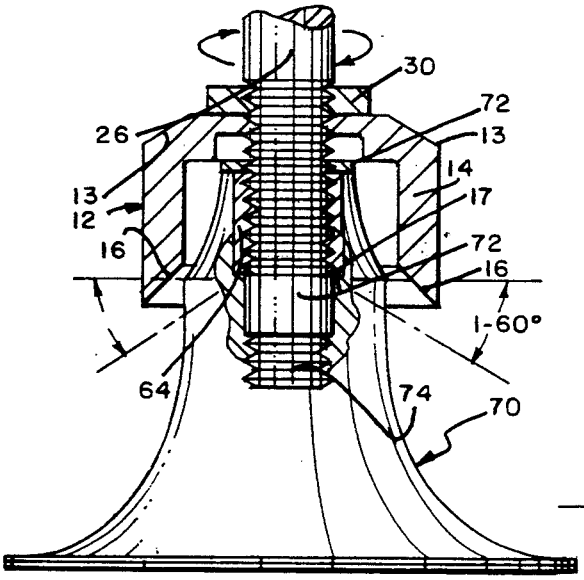
FIG. 25
FIG. 24
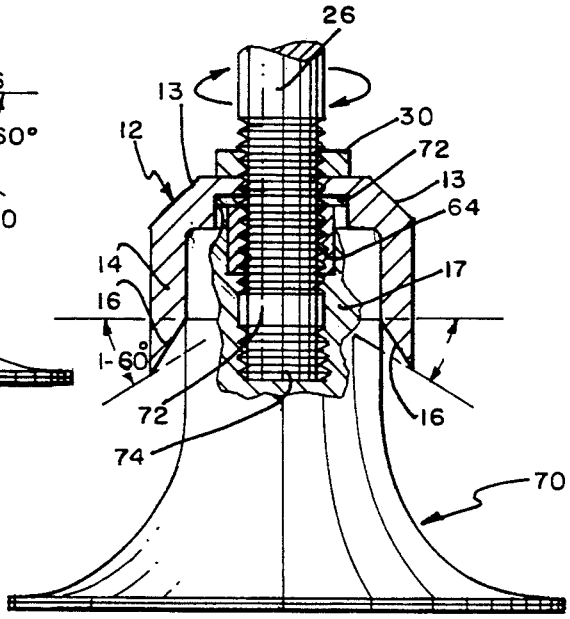

APPARATUS AND METHOD FOR PRODUCING AND OSCILLATING, AN ORBITING AND A VIBRATING MOVEMENT ON A DISC BODY

FIELD OF THE INVENTION

This invention is related to a resilient coupling. More specifically, this invention provides a resilient coupling that is to be employed in or with a rotatable sanding or buffing tool.

DESCRIPTION OF THE PRIOR ART

A patentability investigation was conducted and the following U.S. patents were discovered: U.S. Pat. No. 2,371,021 to Berry; U.S. Pat. No. 2,633,008 to Tocci-Guilbert; U.S. Pat. No. 3,053,063 to Lilleberg; and U.S. Pat. No. 4,674,234 to Reiling et al. None of the foregoing prior art patents teach or suggest the particular resilient coupling of this invention.

SUMMARY OF THE INVENTION

The present invention accomplishes its desired objects by providing a resilient coupling that broadly comprises a cup-shaped sleeve means having a cylindrical sleeve wall that terminates in a cylindrical sleeve end . An elastomeric or resilient pad means is disposed within the cup-shaped sleeve means. The pad means has a cylindrical elastomeric pad means and terminates in an elastomeric pad end . The resilient coupling additionally comprises a threaded hub embedded within the elastomeric pad means . The threaded hub has a threaded longitudinal hub opening, a hub top, and a hub bottom that generally registers with the elastomeric pad end and is spacedly disposed from the cylindrical elastomeric wall such that the elastomeric end is directly exposed to the atmosphere and is not covered as with a flange . The resilient coupling of this invention is disposed between a driving rotating shaft and a driven rotating shaft and enables the driven rotating shaft to simultaneously produce an oscillating, orbiting, and vibratory movement from the rotating driving shaft. The extent or magnitude of oscillation, orbitation, and vibration can be controlled by the length and/or point of termination of the cylindrical sleeve wall. Preferably, the cylindrical sleeve end of the cylindrical sleeve wall terminates at or between a point that generally registers with a horizontal plane of the planar surface of the hub top and a point that registers with a horizontal plane of the planar surface of the hub bottom. The closer that the cylindrical sleeve end is formed to the horizontal plane of the planar surface of the hub top, the greater the extent of oscillation, orbitation, and vibration movement. Similarly, the closer that the cylindrical sleeve end is formed to the horizontal plane of the planar surface of the hub bottom, the smaller the extent of oscillation, orbitation, and vibration movement.

It is therefore an object of the present invention to provide a resilient coupling.

These, together with the various ancillary objects and features which will become apparent to those skilled in the art as the following description proceeds, are attained by this novel resilient coupling, a preferred embodiment being shown with reference to the accompanying drawings, by way of example only, wherein:

BRIEF DESCRIPTION OF THE DRAWINGS

FIG. 1 is a perspective view of the resilient coupling engaged to a revolving shaft at one end with an abrasive or buff pad at the other end;

FIG. 2 is a top plan view of the resilient coupling having a shaft which is capable of rotating attached thereto;

FIG. 3 is a bottom plan view of the conventional disc body having a driven shaft secured thereto;

FIG. 4 is a bottom plan view of the conventional disc body;

FIG. 5 is a vertical sectional view taken in direction of the arrows and along the plane of line 5—5 in FIG. 2;

FIG. 6 is a vertical sectional view taken in direction of the arrows and along the plane of line 6—6 in FIG. 3;

FIG. 7 is a perspective view of the flanged head having a male fitting secured at one end and a pad at the other end;

FIG. 8 is a perspective view of the pad;

FIG. 13 is a bottom plan view of the sleeve of FIG. 11;

FIG. 14 is a vertical sectional view taken in direction of the arrows and along the plane of line 14—14 in FIG. 11;

FIG. 15 is a perspective view of the elastomeric pad with a pair of hub flanges secured at opposed ends thereof;

FIG. 16 is a partial vertical sectional view of an embodiment of the resilient coupling with a driving shaft secured at one end and a driving shaft-disc body combination secured at the other end;

FIG. 17 is a partial vertical sectional view of still yet another embodiment of the resilient coupling;

FIG. 18 is a partial vertical sectional view of still further yet another embodiment of the resilient coupling;

FIG. 19 is a perspective view of the pot- or cup-shaped sleeve in an inverted position;

FIG. 20 is a perspective view of the hub having a hub top bound at one end and a hub bottom bound at the other end;

FIG. 21 is a side elevational view of the driving shaft;

FIG. 22 is a partial vertical sectional view of another embodiment of the pair of resilient couplings of FIG. 9;

FIG. 23 is a partial vertical sectional view of still yet another embodiment of the pair of resilient couplings of FIG.

FIG. 24 is a partial vertical sectional view of still yet another embodiment of the resilient coupling of FIG. 18; and FIG. 25 is a partial vertical sectional view of still yet a further embodiment of the resilient coupling of FIG. 18.

DETAILED DESCRIPTION OF THE INVENTION

Figure 9:
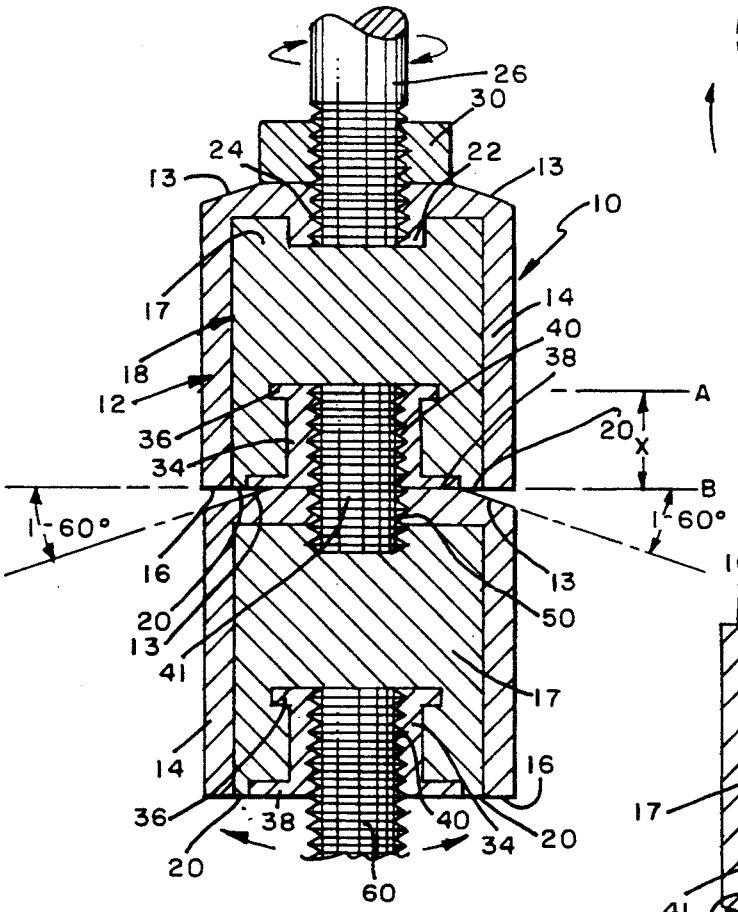
FIG. 9 is a partial vertical sectional view of a pair of resilient couplings interconnected by a driven shaft with one coupling having secured thereto a driving shaft and with the other resilient coupling having secured thereto an ultimately driven shaft.
Figure 12:
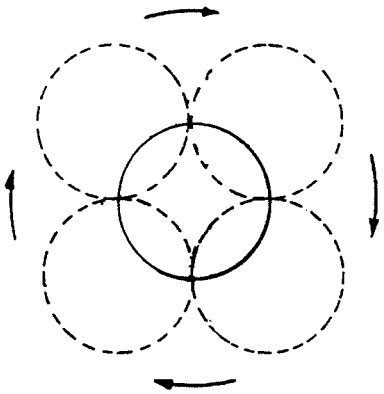
FIG. 12 is a diagram of the orbitation travel or movement the driven shaft and/or conventional disc body.

Referring in detail now to the drawings wherein similar parts of the invention are identified by like reference numerals, there is seen a resilient coupling, generally illustrated as 10, having various preferred embodiments. In the embodiment of FIGS. 5 and 16, the resilient coupling 10 has a pot- or cup-shaped sleeve, generally illustrated as 12, having a sloping surface 13 concentrically disposed around the top thereof and a cylindrical sleeve wall 14 that terminates in a cylindrical sleeve end 16. An elastomeric (e.g. a vulcanized rubber-like material) pad 17 is positioned within the cup-shaped sleeve 12 such as to have a cylindrical elastomeric wall, generally illustrated as 18, that terminates in an elastomeric pad end 20. One end of the cup-shaped sleeve 12 is formed with a projecting internal hub 22 having a threaded hub bore 24 which threadably receives a driving shaft 26 that can be rotatably driven by a tool 28. A locking nut 30 is preferably threadably engaged to or around the driving shaft 26 to lock the driving shaft 26 within the threaded hub bore 24 when the nut 30 is flushed against the sleeve 12 as illustrated in FIG. 5. The cylindrical sleeve wall 14 is formed with a plurality of longitudinal slots 32 that interrupt the sleeve end 16. The slots 32 allow the elastomeric pad 17 to breathe while being exposed to the atmosphere and remain more (or become more) resilient and flexible than if the slots 32 were not formed in the sleeve wall 14.

A hub 34 is embedded within the elastomeric pad 17. Preferably, the hub 34 includes a flanged hub top 36, a flanged hub bottom 38, and a threaded longitudinal opening 40 which longitudinally passes through the hub 34. A driven shaft 41 is threadably secured within longitudinal opening 40 and is primary receiver/transmitter of oscillation, orbitation, and vibration movement.

As best illustrated in FIG. 5, the planar surface of the flanged hub bottom 38 registers or is aligned with the Dad end 20 which is directly exposed to the atmosphere and is not covered imposed with any mechanical member such as a flange. Furthermore, the flanged hub bottom 38 is spaced from the elastomeric wall 18 with the pad end 20 disposed therebetween. As will be explained more thoroughly, these features in combination with other features enable the elastomeric pad 17 to have greater flexibility and resiliency in procucing a greater larger orbitation, vibration, and oscillation movement on or with the shaft 41 from a rotating driving shaft 26.

The length of the cylindrical sleeve wall 14 determines the amount or the extent of orbitation, vibration, and oscillation movement and may vary from a point where the sleeve end 16 generally registers with a horizontal plane identified as "A" in the Figures (e.g. see FIGS. 5 and 22) down to a point where the sleeve end 16 generally registers with a horizontal plane identified as "B" in the Figures (e.g. see FIGS. 5 and 9). The possible differential variation in length of the sleeve wall 14 has been indicated as "x" in FIGS. 5, 9, 22, and 23. Plane A is generally planar and registers with the planar surface of the flanged hub top 36 and plane B is generally planar and registers with the planar surface of the flanged hub bottom 38 (and the pad end 20). If a maximum controlled orbitation, vibration, and oscillation movement is desired on shaft 41 from the resilient coupling 10, the cylindrical sleeve wall 14 should be formed such that the sleeve end 16 generally registers with plane A (Note: The sleeve end 16 could be formed above plane A and closer to the internal hub 22 except there would be difficulty in controlling the orbitation, vibration, and oscillation movement.). If a smaller (or a lesser) controlled orbitation, vibration, and oscillation movement is desired on shaft 41 from the resilient coupling 10, the cylindrical sleeve wall 14 should be formed such that the sleeve end 16 generally registers with plane B. The closer that sleeve end 16 is formed to plane A, the greater the orbitation, vibration, and oscillation movement becomes via driven shaft 41. Likewise, the farther that sleeve end 16 is formed away from plane A (or the closer sleeve end 16 is formed to register with plane B), the less the orbitation, vibration, and oscillation movement becomes via driven shaft 41. If the sleeve end 16 of the cylindrical sleeve wall 14 is positioned or formed at any point above plane B, the cylindrical elastomeric wall 18 is expanded or flanged outwardly to form an elastomeric pad flange 42 (see FIGS. 22 and 23) that increases the thickness of the elastomeric pad end 20 by the thickness of the-cylindrical sleeve wall 14. Stated alternatively, the formation of the pad flange 42 increases the distance of the outer extremity of the flanged hub bottom 38 from or to the outer extremity of the pad flange 40, resulting in more elastomeric pad 17 between sleeve end 16 and plane B and more or greater simultaneous orbitation vibration and oscillation on and/or with driven shaft 41.

In the embodiment of the FIGS. 5 and 16 resilient coupling 10, a conventional disc body, generally illustrated as 44, may be secured to the driven shaft 41 and locked with locking nut 30 to be the direct recipient of the simultaneous orbitation, vibration and oscillation movement. Conventional disc body 44 generally or typically has a disc head 46 which is threaded for threadably receiving the threaded end of the driven shaft 41. Integrally bound or formed with the disc head 46 is a resilient disc torso 48 having a threaded hollow disc shaft 49 implanted therein for threadably receiving or accepting a threaded male fitting 52 with a flanged head 54 that assists in retaining the torso 48 against the disc head 46. A void space 56 may be typically formed between the resilient torso 48 and the hollow shaft 50. A pad 58, which may be abrasive or soft, is secured to the torso 48 and to the flanged head 54 and is the contact member with the surface to be abrasively cleaned or buffed/polished.

In the embodiment of the resilient coupling 10 depicted in FIGS. 9, 22, and 23, the threaded driven shaft 41 becomes an intermediate shaft and is threadably engaged to a lower pot- or cup-shaped sleeve 12 which is identical to the upper sleeve 12 except the projecting internal hub 22 has not been formed in the lower sleeve 12. The lower sleeve 12 does include a threaded sleeve bore 50 which receives the threaded driven shaft 41. The remaining features and elements (e.g. pad 17, hub 34, pad end 20, plane A, plane B, differential variation "x", etc.) of the lower sleeve 12 are all identical to the upper sleeve 12 which was described above. A threaded ultimately driven shaft 60 threadably engages the threaded opening 40 of the hub 34 disposed in the lower sleeve 12. Shaft 60 is a receiver of the simultaneous orbitation, vibration, and oscillation movement. The conventional disc body 44 may be engaged to the threaded ultimately driven shaft 60 to be the direct recipient of the simultaneous orbitation, vibration, and oscillation movement. The sloping surface 13 of the lower sleeve 12 has a plane that generally forms an angle of 1 to 60 degrees with the planar surface (i.e., plane B) of the flanged hub bottom 38 and the pad end 20. As was indicated, the shaft 41 has produced thereon or therewith a defined and controlled simultaneous orbitation, vibration, and oscillation movement. By threadably securing the lower sleeve ]2 to the orbiting, vibrating, and oscillating shaft 41, additional orbitation, vibration, and oscillation movement is created on or from the threaded ultimately driven shaft 60, which is orbitation, vibration, and oscillation over and beyond the orbitation, vibration, and oscillation on shaft 41. The amount or extent of this additional orbitation, vibration, and oscillation movement is directly proportional to (and is controlled by) the size of the angle between the plane of the sloping surface 13 and the plane B and the thickness of the pad flange 42 which may vary from zero for when sleeve end 16 registers with plane B (see FIG. 9) to a value of "x" when sleeve end 16 registers with plane A (see FIG. 23). The layer the angle is between the plane of the sloping surface 13 and the plane B, and/or the larger the thickness of the pad flange 42, the greater the amount or the extent of the additional simultaneous orbitation, vibration, and oscillation. Thus, the securing in series of one or more additional sleeves 12 to the upper sleeve 12 produces additional orbitation, vibration, and oscillation movement.

Figure 10:
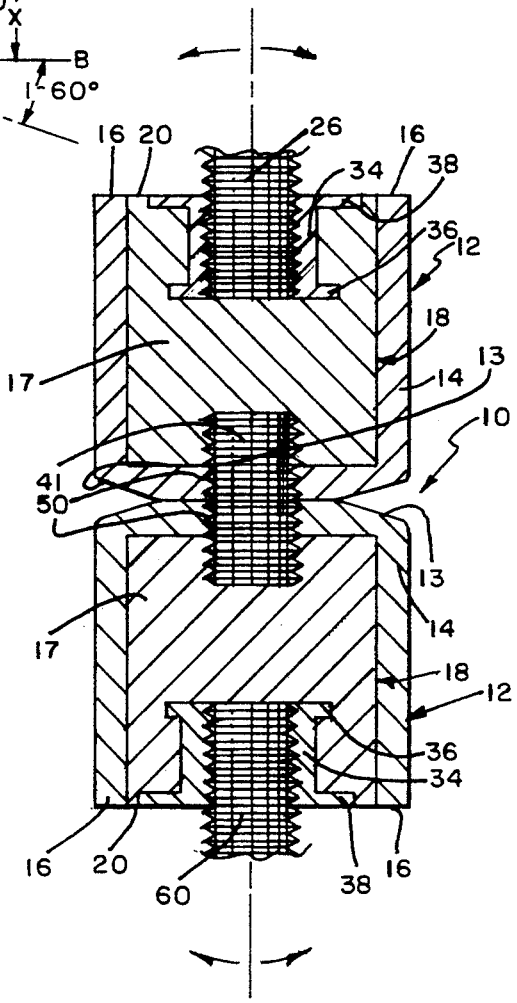
FIG. 10 is a partial vertical sectional view of still yet another embodiment of a pair of resilient couplings interconnected by a driven shaft with one coupling having secured thereto a driving shaft and with the other resilient coupling having secured thereto an ultimately driven shaft.
Figure 11:
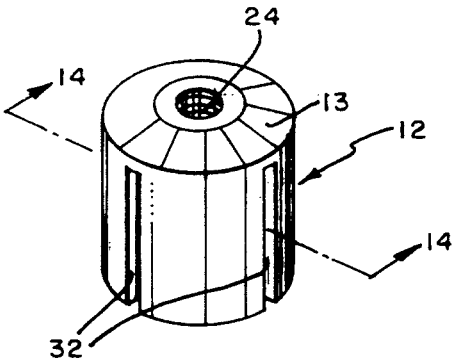
FIG. 11 is a perspective view of the pot- or cup-shaped sleeve.

In the embodiment for the resilient coupling 10 in FIG. 17, the elastomeric pad 17 has a longitudinal elastomeric bore 62 positioned concentrically therein such as to interconnect hub bore 24 and opening 40 and allow shaft 26 to also threadably connect to hub 34 in addition to hub 22. This FIG. 17 embodiment of the invention would decrease the amount or extent of simultaneous orbitation, vibration, and oscillation movement. In the embodiment in FIGS. 15 and 16, the elastomeric pad 17 is embedded with hubs 64 and 66 and respectively include threaded bores 68 and 70 and hub flanges 72 and 74. In the embodiment for the resilient coupling 10 in FIG. 10, the upper sleeve 12 is inverted with respect to the lower sleeve 12 and the driving shaft 26 threadably engages hub 34 and driven shaft 41 threadably engages the threaded sleeve bore 50 of the upper sleeve 12. This embodiment produces a rigid, fixed connection on shaft 41. In the embodiment of the invention in. FIGS. 18, 24, and 25, an embodiment of the sleeve 12 (see FIG. 19) is threadably disposed to driving shaft 26 on the outside of a disc body, generally illustrated as 70. This embodiment of the sleeve 12 may be locked on shaft 26 above the disc body 70 as illustrated in FIGS. 18 and 25, or the sleeve 12 may be flushed against the flange 72 of hub 64 (as illustrated in FIG. 24) that is embedded in elastomeric pad 17 contained within the disc body 70. The elastomeric pad 17 in FIGS. 18, 24, and 25 has an elastomeric bore 72 and an elastomeric threaded bore 74 communicating and coaxial with elastomeric bore 72. In FIG. 18, shaft 26 passes through elastomeric bore 72 and threadably engages elastomeric threaded bore 74, whereas in FIGS. 24 and 25 shaft 26 does not pass entirely or completely through elastomeric bore 72 in order to thread to threaded bore 74. The sleeve end 16 of sleeve 12 for the embodiment of the invention in FIGS. 18, 24, and 25 is beveled as indicated.

Thus, by the practice of my invention, there is provided a product that is able to obtain three objectives: oscillating, orbiting, and vibratory movement. My invention is designed for the holder pad or the driven device to move. In my invention the driven shaft is suspended between the driven holder pad by an elastic material such as rubber (or a spring could be used) which allows the driven subject to find its own center line. The limits of this action are controlled by the cap that encloses the driven mechanism. Therefore, the driven source can achieve an orbital, oscillating, vibratory action with varying degrees pressure applied. The shank may be engaged by screwing it through the suspended material, thus making my tool rigid. My invention has the ability to absorb the torque between the driving source and the finishing pad; and will yield and conform to the surface being worked on. It absorbs vibration and minimizes the transmission of the same to the drive shaft. The greater the pressure, the greater the deviating eccentricity resulting in the oscillating orbiting, which makes it possible to use all of the available abrasives of the sanding and polishing materials. The oscillating and orbiting also eliminates concentric scratch lines on the work piece. This provides a person with little or no skill of grinding or polishing the ability to leave a better finish on the surface being worked. With little or no pressure, the flex shaft attachment (m invention) runs on a straight axis which it decides. Since the drive shaft and the holder pad are separated by a flexible material (such as rubber), this enables the tool to find its own center line. This separation enables the tool to be run in a vertical upright position against a horizontal workpiece with little or no vibration.

My invention has the capabilities of running true to center line of the tool and abrasive pad or being flexed to varying degrees without the tool running off, unlike the prior art, which will not run on true center without run-off and extreme vibration. Also in my invention, two devices could be incorporated to make one tool to further increase flexibility which would enable accessibility to hard places to polish or sand. The body of my invention can be attached to various sizes and types of abrasive holding discs by changing from a male thread to a female adapter or vice versa whenever necessary. Also the driver can be turned over where the shank will move. My invention can be adapted to various sanding and polishing devices. It can be adapted for use with various materials available.

While the present invention has been described herein with reference to particular embodiments thereof, a latitude of modification, various changes and substitutions are intended in the foregoing disclosure, and it will be appreciated that in some instances some features of the invention will be employed without a corresponding use of other features without departing from the scope of the invention as set forth.

I claim:

1. A resilient coupling comprising a cup-shaped sleeve means having a cylindrical sleeve wall terminating in a cylindrical sleeve end;

an elastomeric pad means disposed within said cup-shaped sleeve means, said elastomeric pad means having a cylindrical elastomeric wall and terminating in an elastomeric pad end;

a threaded hub embedded within said elastomeric pad means, said threaded hub having a hub top with a general planar surface, a hub bottom with a general planar surface and a threaded longitudinal hub opening; and said hub bottom generally registers with said elastomeric pad end and is spaced from said cylindrical elastomeric wall with said elastomeric end directly exposed to the atmosphere.

2. The resilient coupling of claim 1 wherein said cylindrical sleeve end generally registers with a horizontal plane of the planar surface of said hub top.

3. The resilient coupling of claim 1 wherein said cylindrical sleeve end generally registers with a horizontal plane of the planar surface of said hub bottom.

4. The resilient coupling of claim 2 wherein said hub top defines a top hub flange.

5. The resilient coupling of claim 3 wherein said hub bottom defines a bottom hub flange.

6. The resilient coupling of claim 1 wherein said cylindrical sleeve wall of said cup-shaped sleeve means defines at least one longitudinal slot disposed substantially along the length of the cylindrical wall.

7. The resilient coupling of claim 1 wherein said cylindrical sleeve end terminates between a point that registers with a horizontal plane of the planar surface of said hub top and a point that registers with a horizontal plane of the planar surface of said hub bottom.

8. The resilient coupling of claim 1 wherein said cup-shaped sleeve means has a structure defining a projecting internal hub having a threaded hub bore.

9. The resilient coupling of claim 8 additionally comprising an intermediate threaded shaft threadably engaged into said hub opening, a second cup-shaped sleeve means having a structure defining a threaded sleeve bore and a second cylindrical sleeve wall terminating in a second cylindrical sleeve end, said intermediate threaded shaft is threadably engaged into said threaded sleeve bore; a second elastomeric pad means disposed within said second cup-shaped sleeve means, said elastomeric pad means having a second cylindrical elastomeric wall and terminating in a second elastomeric pad end; and a second threaded hub embedded within said second elastomeric pad means.

10. The resilient coupling of claim 9 wherein said second threaded hub has a second hub top with a general planar surface, a second hub bottom with a general planar surface and a second threaded longitudinal hub opening, and said second hub bottom generally registers with said second elastomeric pad end and is spaced from said second cylindrical elastomeric wall with said second elastomeric end directly exposed to the atmosphere.

11. The resilient coupling of claim 10 wherein said second cylindrical sleeve end generally registers with a horizontal plane of the planar surface of said second hub top.

12. The resilient coupling of claim 10 wherein said second cylindrical sleeve end generally registers with a horizontal plane of the planar surface of said second hub bottom.

13. The resilient coupling of claim 11 wherein said second hub top defines a second top hub flange.

14. The resilient coupling of claim 12 wherein said second hub bottom defines a second bottom hub flange.

15. The resilient coupling of claim 10 wherein said second cylindrical sleeve wall of said second cup-shaped sleeve means defines at least one second longitudinal slot disposed substantially along the length of the second cylindrical wall.

16. The resilient coupling of claim 10 wherein said second cylindrical sleeve end terminates between a point that registers with a horizontal plane of the planar surface of said second hub top and a point that registers with a horizontal plane of the planar surface of said second hub bottom.

17. The resilient coupling of claim 10 wherein said second cup-shaped sleeve means has a structure defining a sloping surface disposed around said threaded sleeve bore and concentric thereto, said sloping surface having a plane having an angle of 1 to 60 degrees with the planar surface of the hub bottom.

18. The resilient coupling of claim 17 additionally comprising a driving shaft threadably engaged within said threaded hub bore, and a driven shaft threadably engaged within said second threaded longitudinal hub.

19. The resilient coupling of claim 8 wherein said elastomeric pad means has a longitudinal elastomeric bore extending from said projecting intermediate hub to said hub top of said threaded hub, said longitudinal elastomeric bore is concentric with said threaded longitudinal hub opening and with said threaded hub bore.

20. The resilient coupling of claim 19 additionally comprising a driving shaft threadably engaged to said threaded longitudinal hub opening and passing through said longitudinal elastomeric bore and threadably engaged to said threaded longitudinal hub opening.

* * * * *